US007246546B1

(12) United States Patent
Knoblock et al.

(10) Patent No.: US 7,246,546 B1
(45) Date of Patent: Jul. 24, 2007

(54) LOOSENING TOOL FOR THREADED PIPE COUPLINGS

(76) Inventors: Kris Knoblock, 3420 Woodhaven Dr., Springfield, IL (US) 62707; Fred Knoblock, 3420 Woodhaven Dr., Springfield, IL (US) 62707

( * ) Notice: Subject to any disclaimer, the term of this patent is extended or adjusted under 35 U.S.C. 154(b) by 0 days.

(21) Appl. No.: 11/447,364

(22) Filed: Jun. 6, 2006

(51) Int. Cl.
*B25B 5/00* (2006.01)
*B25B 1/00* (2006.01)
*B25B 33/00* (2006.01)

(52) U.S. Cl. ..... 81/184; 269/249; 269/258; 269/164

(58) Field of Classification Search ..... 81/57.32, 81/426, 424, 424.5, 184, 180.1; 269/45, 269/87, 164, 170, 249, 258
See application file for complete search history.

(56) References Cited

U.S. PATENT DOCUMENTS 1,497,107 A * 6/1924 Lasell ..... 72/390.7
2,540,553 A * 2/1951 Shobe ..... 81/57.32
3,811,668 A * 5/1974 Kotter ..... 269/258
4,305,316 A * 12/1981 Lehman ..... 81/180.1
4,363,475 A * 12/1982 McCarty ..... 269/69
5,062,326 A * 11/1991 Goldschmidt ..... 81/57.32
5,788,809 A * 8/1998 Brennan ..... 156/581

* cited by examiner

*Primary Examiner*—David B Thomas
(74) *Attorney, Agent, or Firm*—Law Office of Robert M Patino

(57) ABSTRACT

A loosening tool for breaking loose tightened threads of a pipe coupling using a plurality of wrench type devices is provided that is simple to use, offers more breakage force than muscling alone, and is relatively safe and effective in its operation. The loosening tool includes a forward facing support jaw, a base bar that supports a corresponding rearward facing support jaw and an adjusting mechanism used to move the forward facing support jaw from a ready position to a loosened position such that the pipe coupling moves to a less tightened position.

15 Claims, 7 Drawing Sheets

LOOSENING TOOL FOR THREADED PIPE COUPLINGS

BACKGROUND OF THE INVENTION

The present invention relates to a loosening tool for breaking loose tightened threads of a pipe coupling using a plurality of wrench type devices, and more particularly to such a loosening tool used to accommodate two opposing wrenches fixedly attached to opposite sides of a pipe coupling and driving each wrench's respective lower part towards each other to loosen the threaded coupling.

Pipe couplings are commonly used in attaching and securing several pieces of pipes together. Typically, couplings are provided with a threaded female receiving interior to receive a corresponding male threaded end of a pipe. When two pipes need to be coupled together, the male threaded end of the pipe is fed into the female threaded receiving interior of the coupling until the fit is tight and secure. On an opposite side of the coupling, a second pipe with a male threaded end is fed into its corresponding female threaded receiving interior. Pipe couplings are also used as joints to redirect the flow of a fluid or create multiple channels of conducting fluid transport. Other pipe members are fitted with a male threaded end at one end and a female threaded end at the opposite end eliminating the need for a pipe coupling piece.

Pipe couplings are often neglected for extended periods of time during the lifetime of a pipeline that uses at least one pipe coupling. Generally, unless there is a need to move a particular pipeline, the pipe coupling is not visited unless there is a problem within the pipeline itself. After the extended period of neglect, the pipe couple can become corroded onto the pipe itself. The fluid being transported within the pipe and the type pipe material used may enhance the impact of the corrosion found between the pipe and the pipe coupling. Furthermore, an extended period of stress between the pipe coupling and the corresponding pipe's male threaded end will increase the frictional force found binding the two surfaces together. Both of these factors will increase the force needed to break a coupling bond found holding the pipe and the pipe coupled together.

Pipes and pipe couplings are also often found in "hard to reach" places. These couplings can be found within walls, under cabinets, underneath flooring, and many other similar "hard to reach" places. It can be difficult to fit two independent wrenches into such a space and using both hands to apply enough force sufficient to break apart the coupling bond. Balancing one's self to exert the proper amount of force in awkward positions can cause injury if the balance is lost. Moreover, hands have the ability lose their grip when applying such force which might further induce injury to the body. Furthermore, if the bond between the pipe's male threaded end and the pipe coupling were to suddenly disappear, the hands holding the lower part of each wrench type device could strike each other during the loosening action of the two components.

The current means of breaking loose tightened threads using two pipe wrenches is limited by the force generated by the body's muscle strength. This means does not always guarantee a successful bond breakage if the friction force securing the pipe coupling to the pipe is greater than the strength capable of being exerted by the user of the two pipe wrenches. A hammer or a cutting device would have to be applied to brutally force apart the pipe and the pipe coupling, resulting in permanent damage to the pipe member or pipe coupling; rendering it unuseable for future use.

Therefore, it is desired to have a loosening tool that can apply a greater amount of force to a plurality of wrench type devices than what can be achieved by muscling alone. Furthermore, it is desired that this loosening tool limit the risks associated with injury to the hands or body in the event that rapid loosening might otherwise cause. The loosening tool should be capable of fitting into hard to reach areas while giving the user a friendly means of operating the loosening tool. Moreover, it is desirable to have a loosening tool that is compatible with an assortment of sizes and shapes of wrench like devices such as vice grips while being adjustable to particular placement requirement of the wrench like devices on the pipe or pipe coupling itself.

Thus, there is a need for a loosening tool capable of supporting a plurality of pipe wrenches and wrench type devices. The loosening tool needs to be small enough to fit into difficult to reach places while being simple to operate. Furthermore, there is a need for such a loosening tool that is safe and easy to operate while being economically affordable to persons engaged in maintenance and repair type activities.

BRIEF SUMMARY OF THE INVENTION

The above-identified needs are addressed by the present loosening tool for breaking loose tightened threads of a pipe coupling. One feature of the present invention is the ability to be interchangeably usable with a variety of wrench type devices, including but not limited to, vice grips, adjustable wrenches, pipe wrenches, etc. The loosening tool's small size, cheap construction costs, and durability offer the advantage to a variety of users of being able to induce loosening in a coupling without risking damage to the hands or other parts of the body. A deliberate delivery of force provided by an adjusting mechanism on the tool ensures a greater amount of force action than that which can be achieve by human muscling alone and in a very controlled manner. The applied force can be immediately discontinued when slippage in the bonding forcing within the coupling begins to occur; whereas the hands, which rely on arm strength, have a difficult time controlling the inertia of an impeding collision when holding two wrenches separately.

More specifically, a loosening tool for breaking loose tightened threads of a pipe coupling using a plurality of wrench type devices is provided with a forward facing support jaw and a rearward facing support jaw. The rearward facing support jaw is positioned to correspond with the forward facing support jaw when supporting the wrench type devices. A means of adjusting the forward facing support jaw is further provided to move the forward facing support jaw from a ready position to a loosened position such that the forward facing support jaw and the rearward facing support jaw are moved closer together. A base bar is used to support the rearward facing support jaw and the means of adjusting the forwarding facing support jaw.

In another embodiment, a loosening tool for breaking loose tightened threads of a pipe coupling using a plurality of wrench type devices is further provided with a jaw support arm situated to be slideable relative to a forward facing support jaw. The support arm is fixedly attached to a rearward facing support jaw, where the rearward facing support jaw is positioned to correspond with the forward facing support jaw when supporting the wrench type devices. An adjusting mechanism is used to move the forward facing support jaw from a ready position to a loosened position such that the forward facing support jaw and the rearward facing support jaw are moved closer together. A base bar supports the jaw support arm and the adjustable mechanism.

In yet another embodiment, a loosening tool for breaking loose tightened threads of a pipe coupling using a plurality of wrench type devices is provided with a means of adjusting a rearward facing support jaw slideably. The means of adjusting the rearward facing support jaw slideably is arranged such that the rearward facing support jaw is moveable in a comparatively linear manner relative to a forward facing support jaw. The rearward facing support jaw is positioned to correspond with the forward facing support jaw when supporting the wrench type devices when used in operation. The forward facing support jaw is drivable in a direction towards the rearward facing support jaw using a driving screw mounted on a base bar. The base bar is used to support the rearward facing support jaw and the forward facing support jaw.

DETAILED DESCRIPTION OF THE INVENTION

Figure 1:
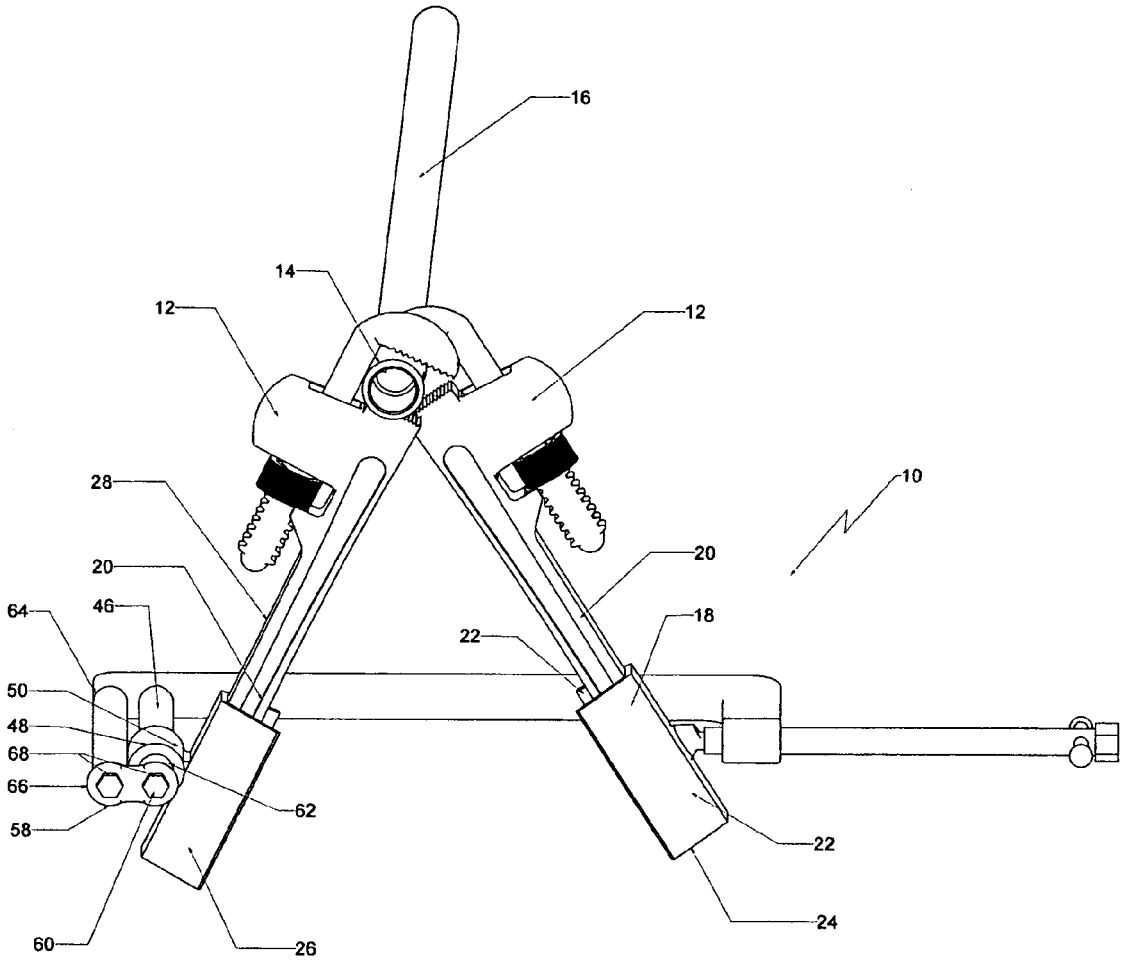
FIG. 1 is a front perspective view of a loosening tool in operation supporting two wrench type devices on a forward facing support jaw and a rearward facing support jaw.

Referring now to FIG. 1, a loosening tool for breaking loose tightened threads of a pipe coupling using a plurality of wrench type devices is generally designated 10. The loosening tool 10 is designed for being receivable to a plurality of wrench type devices 12 such as vice grips, adjustable wrenches and pipe wrenches, and in the most preferred embodiment, to two wrench type devices 12. The wrench type devices 12 are securely fitted onto a pipe coupling 14 and a corresponding piece of the pipe 16. The pipe coupling 14 is typically fitted with a threading (not shown) that employs a female end and a male end, where the pipe coupling 14 is generally used to extend a piece of piping, redirect a path of a particular fluid, or secure a fitting to perform a function for the particular fluid.

Figure 2:
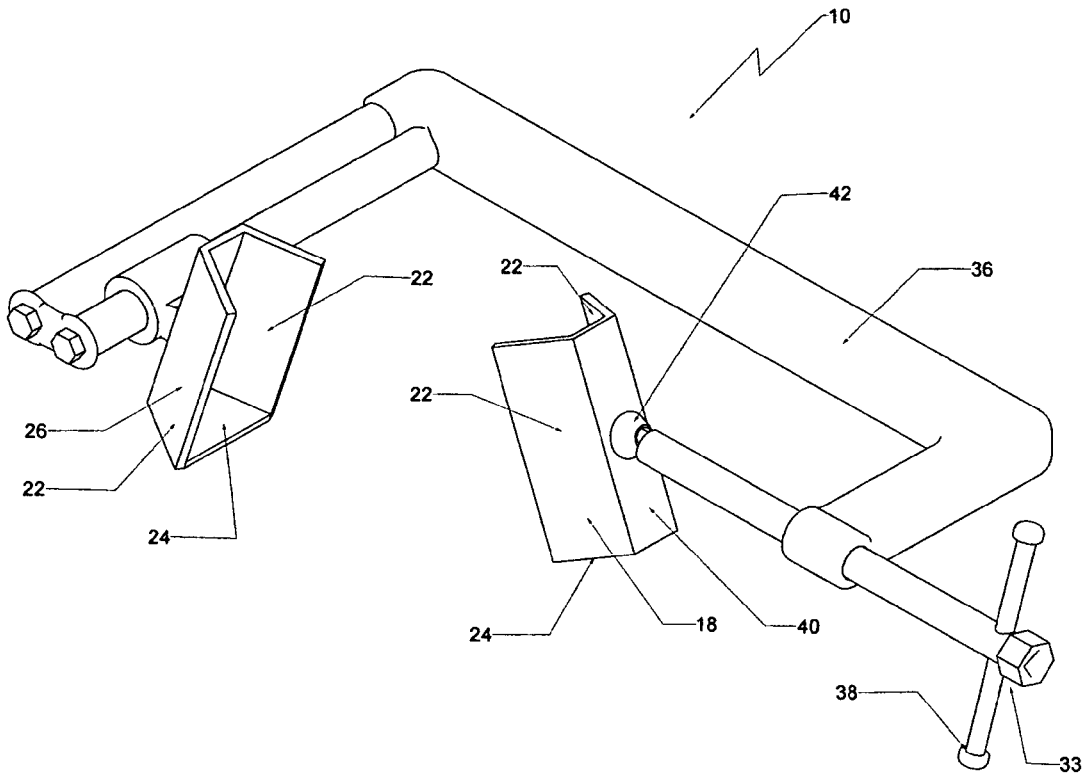
FIG. 2 is a side perspective view of the loosening tool without the wrench type devices.

Now referring to FIGS. 1 and 2, in the preferred embodiment, a forward facing support jaw 18 is provided to adhere to a lower part 20 of the wrench type device 12. The forward facing support jaw 18 is supportable to the lower part 20 of the wrench type device 12 with the help of a set of arms 22 to prevent unintentional sliding of the lower part 20 of the wrench type device 12. In the most preferred embodiment, the set of arms 22 are sharply angled to form a square-like or trapezoidal feature as shown in FIG. 2; however, triangular and rounded designs are also contemplated. It is preferred that the set of arms 22 be extended to substantially cover the width and depth of the lower part 20 of the wrench type device 12 such that the wrench type device 12 does not inadvertently slip out of the forward facing support jaw 18. The forward facing support jaw 18 is optionally provided with a base support member 24 to assist with the placement of the lower part 20 of the wrench type device 12.

A rearward facing support jaw 26 is also provided and is positioned to correspond with the forward facing support jaw 18 when supporting the wrench type devices 12. The rearward facing support jaw 26 performs a similar function as the forward facing support jaw 18 in that the rearward facing support jaw 26 is supportable to the lower part 20 of a corresponding wrench type device 28. The rearward facing support jaw 26 is also provided with a set of arms 22 to prevent unintentional sliding of the lower part 20 of the corresponding wrench type device 28 and is optionally provided with a base support member 24.

Figure 3:
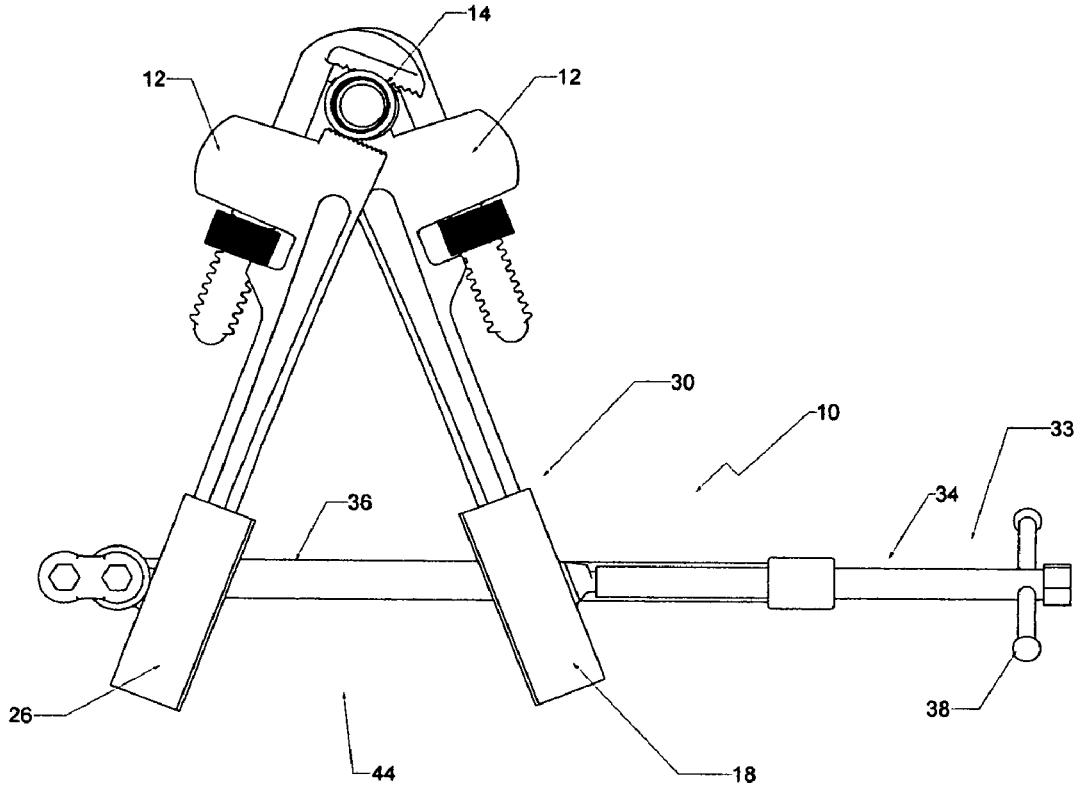
FIG. 3 is a side view of the loosening tool in a ready position engaging two wrench type devices.
Figure 4:
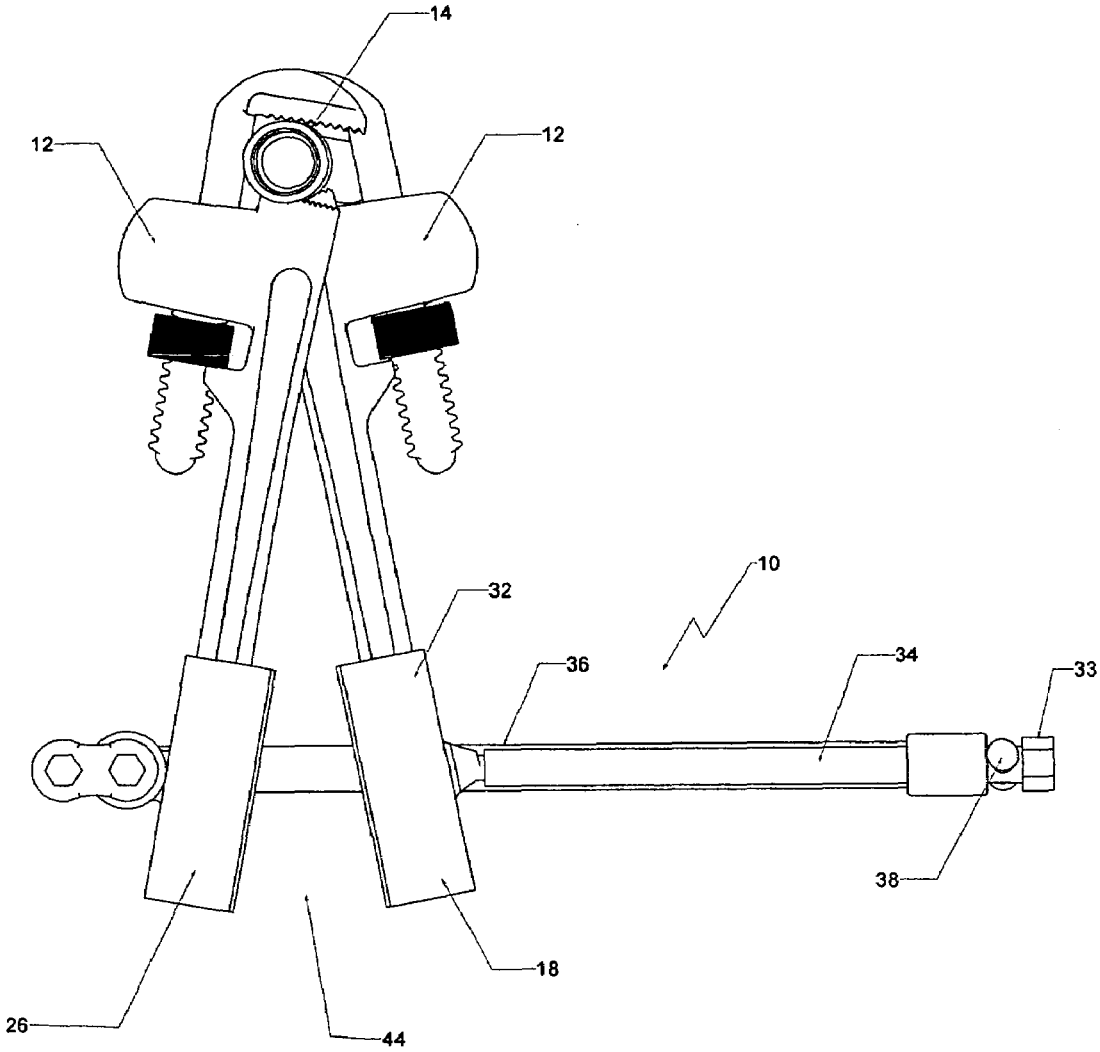
FIG. 4 is a side view of the loosening tool in an extended position engaging two wrench type devices.

Now referring to FIGS. 2, 3, and 4, in the preferred embodiment, a means of adjusting the forward facing support jaw 18 from a ready position 30 as shown in FIG. 3 to an extended position 32 as shown in FIG. 4 is provided such that the forward facing support jaw 18 and the rearward facing support jaw 26 are moved closer together. The ready position 30 is generally defined as the initial point at which the wrench type devices 12 are fixedly secured to the pipe coupling 14. The extended position 32 is any position in which the forward facing support jaw 18 is brought to a closer position to the rearward facing support jaw 26. Assuming that the wrench type devices 28 are properly attached, the extended position 32 of the forward facing support jaw 18 should result in a loosening of the pipe coupling 14.

The means of adjusting the forward facing support jaw 18 is preferred to be deliberate and precise such that the speed of adjustment can be well controlled. In the most preferred embodiment, the means of adjusting the forward facing support jaw 18 from the ready position 30 to the extended position 32 is provided by an adjusting mechanism 33 such that the forward facing support jaw 18 and the rearward facing support jaw 26 are moved closer together. The adjusting mechanism 33 is preferably comprised of a driving screw 34 mounted on a base bar 36 such that the forward facing support jaw 18 is drivable in a direction towards the rearward facing support jaw 26. The driving screw 34 is preferably tethered such that the driving force can be controlled by twisting a control handle 38. The amount of force required to twist the control handle 38 can be easily applied without risking injury to the hands because the amount of rotation applied at one time is limited by the physical limitations within the hand and arm structure. The forward facing support jaw 18 can also be adjusted in the opposite manner to release the loosening tool 10 from the wrench type devices 12.

The rotational motion of the driving screw 34 requires a means to keep the forward facing support jaw 18 upright to be coupled with the lower part 20 of the wrench type device 12. In the preferred embodiment, the driving screw 34 is rotatably attached to a rear side 40 of the forward facing support jaw 18 such that the forward facing support jaw 18 is moveable from the ready position 30 to the loosened position 32 while continually supporting the lower part 20 of the wrench type device 12. In the most preferred embodiment, the driving screw 34 is rotatably attached by a forward ball joint fitting 42. The forward ball joint fitting 42 effectively keeps the forward facing support jaw 18 in a substantially upright position when engaged with the lower part 20 of the wrench type device 12 to provide the continued support required for operation.

The base bar 36 is used to support the rearward facing support jaw 26 and the means of adjusting forwarding facing support jaw 18. Several different types of base bars 36 are contemplated. In the most preferred embodiment, the base bar 36 is provided with a "U" type shape to support both support jaws while providing an operating area 44 for adjusting the forward facing support jaw 18 from the ready position 30 to the extended position 32. The operating area 44 needs to be of sufficient size to allow each support jaw to engage their respective wrench type devices 12. The "U" type shape is preferably angled to reside planarly with respect to linear driving direction of the driving screw 34 and parallel to the corresponding piece of the pipe 16 (as shown in FIG. 2).

Figure 5:
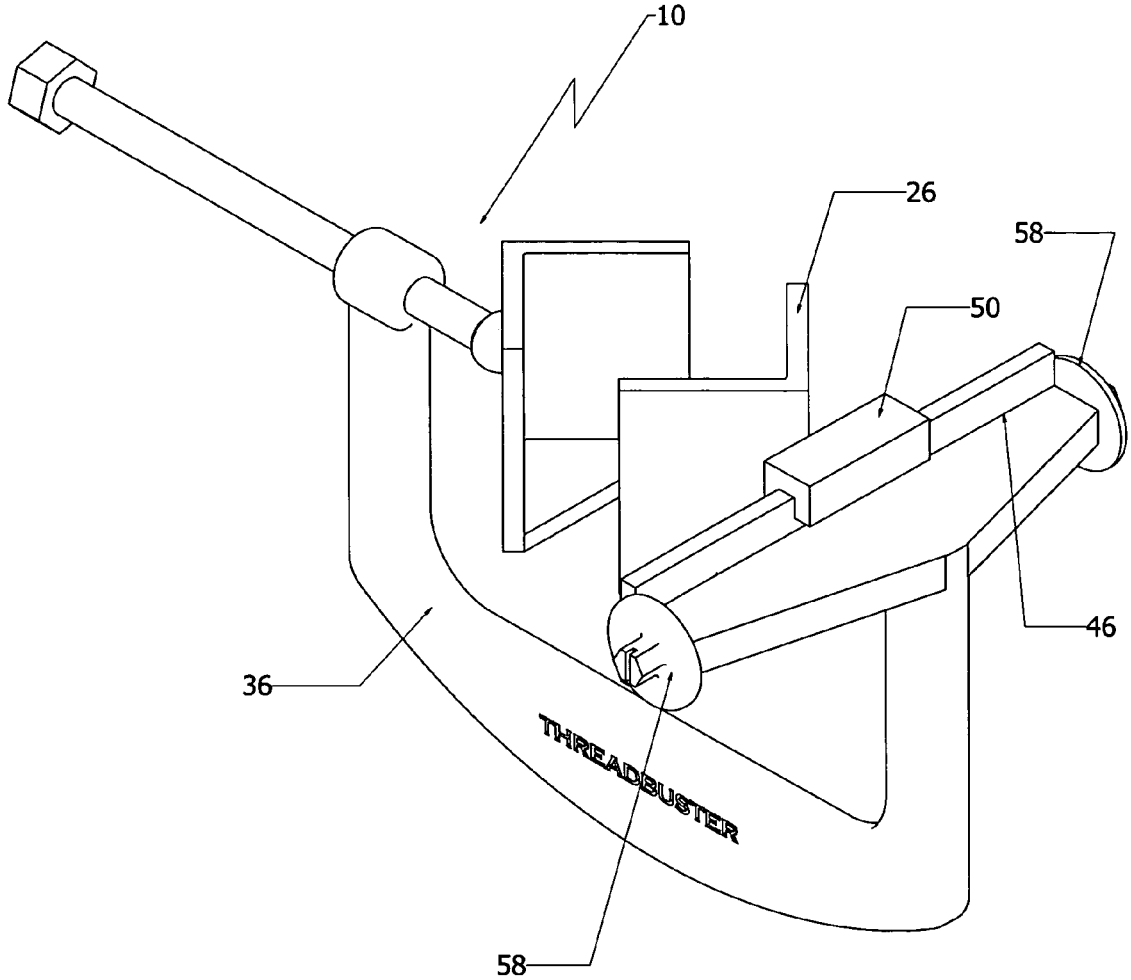
FIG. 5 is an exploded perspective view of the loosening tool to more clearly identify its several parts.
Figure 6:
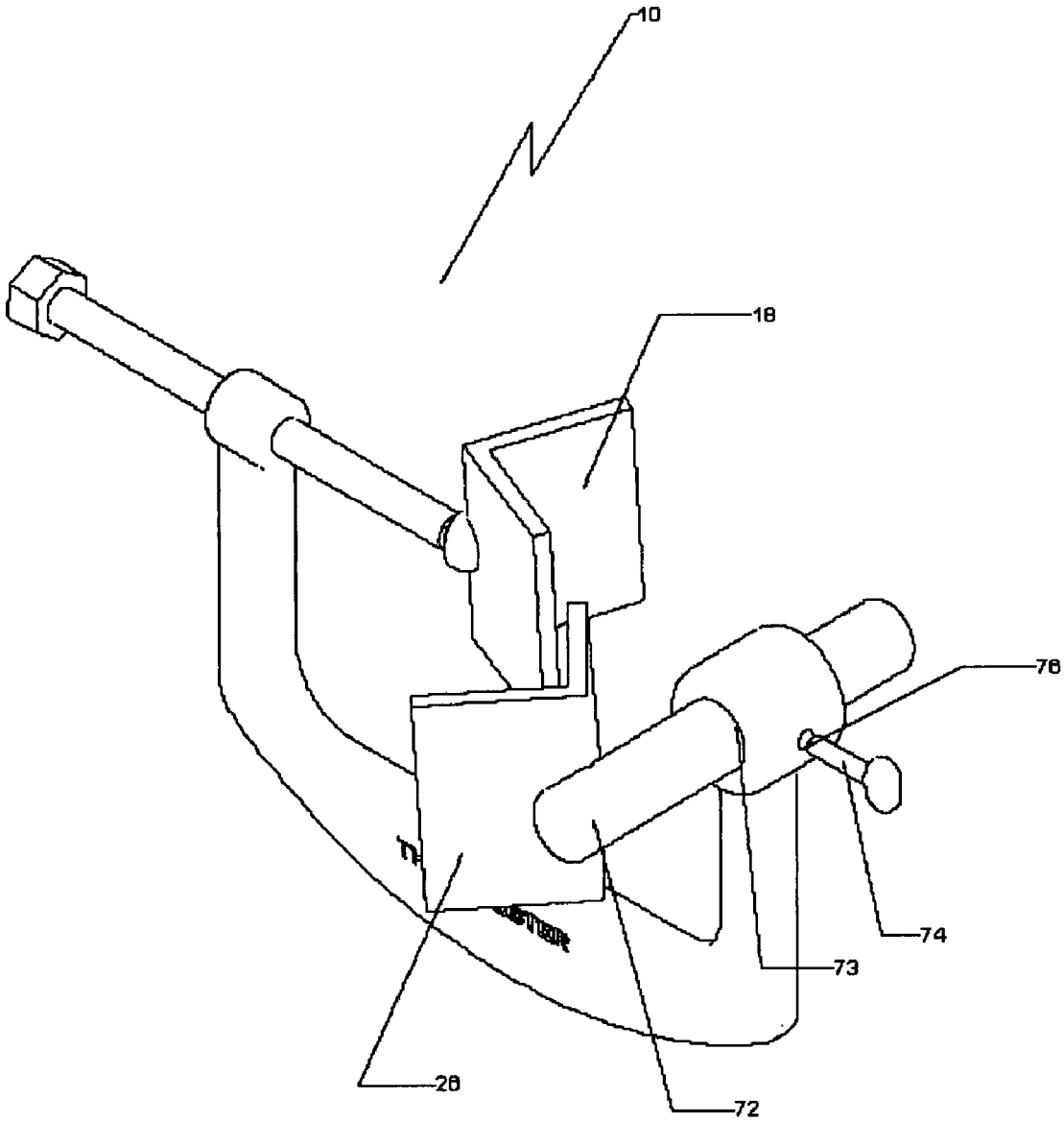
FIG. 6 is a side perspective view of an optional embodiment of the loosening tool with a base bar extended in a horizontal manner.

Now referring to FIGS. 1, 5 and 6, an optional embodiment of the base bar 36 is also contemplated. In the embodiment shown in FIG. 5, the "U" type shape can be extended below the lower part 20 of the wrench type devices 12 to provide optional adjustment technique to allow for an alternative grabbing angle. In the embodiment shown in FIG. 6, the "U" type shape extended below the lower part 20 of the wrench type devices 12 to provides an optional means of adjusting the rearward facing support jaw 26 slideably.

Figure 7:
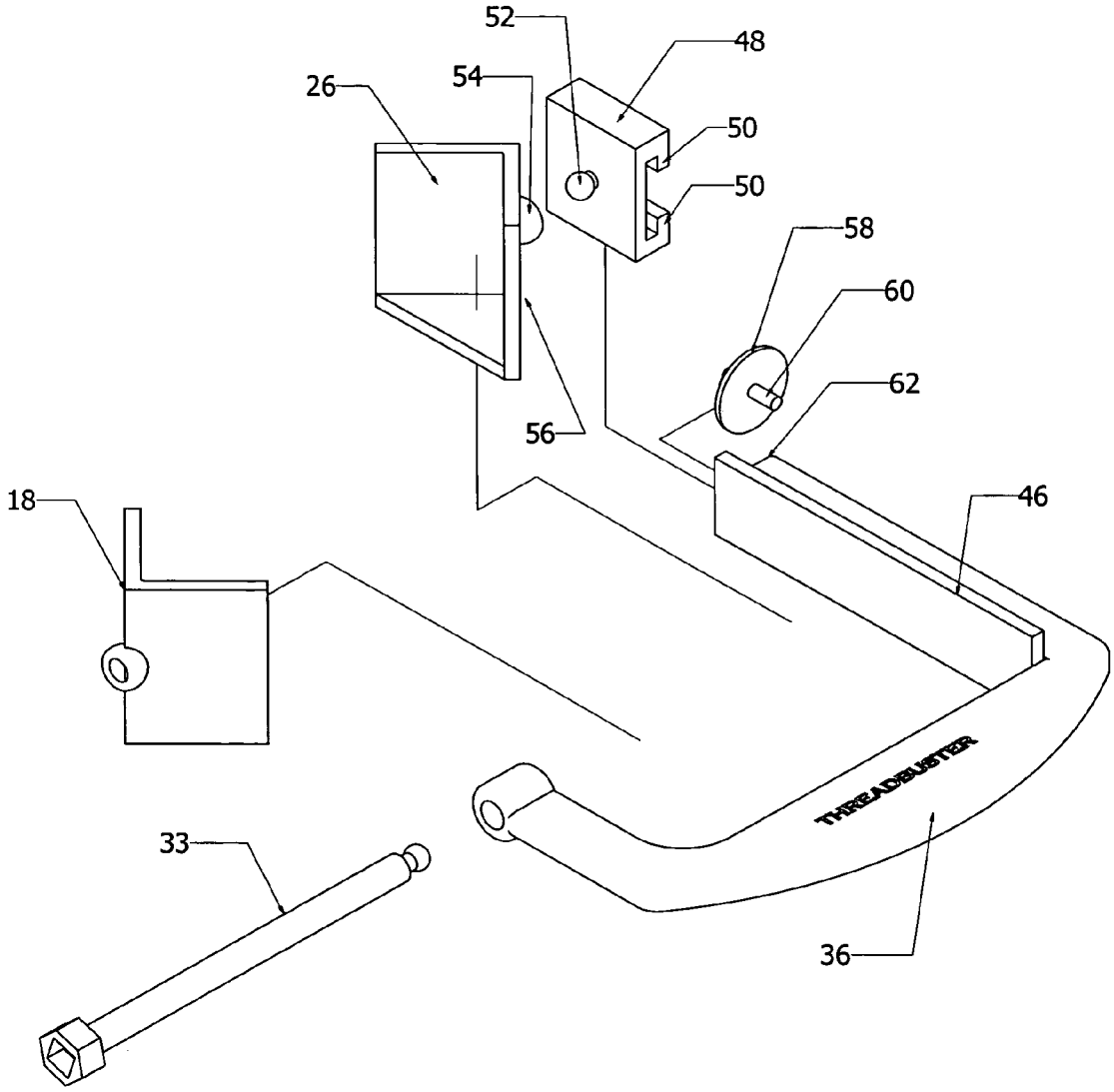
FIG. 7 is a front perspective view of yet an additional embodiment of the loosening tool illustrating a jaw support arm being slideably engaged with the base bar.

Now referring to FIGS. 1, 6, and 7, the means of adjusting the rearward facing support jaw 26 slideably are provided such that the rearward facing support jaw 26 is moveable in a comparatively linear manner relative to the forward facing support jaw 18 so that the rearward facing support jaw 26 will engage the corresponding wrench type device 28 more effectively. The means of adjusting the rearward facing support jaw 26 slideably is most preferably provided by a backside track 46 that is attached to the base bar 36. An adjustable slide 48 is latched onto the backside track 46 with a set of gripping arms 50 that allow the adjustable slide 48 to move freely along the backside track 46 while preventing the adjustable slide 48 from falling off the backside track 46. The rearward facing support jaw 26 is attached to the adjustable slide 48 situated on the backside track 46. In the most preferred embodiment (as shown in FIG. 7), the rearward facing support jaw 26 is pivotally attached to the adjustable slide 48 with a rearward ball joint fitting 52. The rearward ball joint fitting 52 couples with a female receiving end 54 located on a track side 56 of the rearward facing support jaw 26.

Now referring to FIGS. 1, 5 and 7, the rearward facing support jaw 26 situated on the adjustable slide 48 is held onto the backside track 46 with a slide stopper 58. The slide stopper 58 is preferably comprised of a stopper screw 60 where the stopper screw 60 is rotated onto an open end 62 of the backside track 46. The stopper screw 60 is large enough to prevent the set of gripping arms 50 to over take the slide stopper 58. Depending on the direction of the "U" type shape base bar 36 bends, more than one open end 62 of the backside track 46 will exist, thus requiring multiple slide stoppers 58 (as shown in FIG. 5).

Now referring to FIG. 1, in the most preferred embodiment, the backside track 46 runs parallel to a rear portion 64 of the base bar 36. Under this embodiment, the backside track 46 is of a cylindrical shape which eliminates the need for a rearward ball joint fitting 52. The set of gripping arms 50 are shaped to conform to the cylindrical shape of the backside track 46. It is contemplated that the set of gripping arms 50 under this embodiment are one piece to provide a more durable attachment. The slide stopper 58 under this embodiment is provided by a "FIG. 8" shaped member 66 that is configured to be placed on the open end 62 of the backside track 46 and the rear portion 64 of the base bar 36. The slide stopper 58 is then fixated by a set of stopper screws 68 that attach onto a set of respective female receiving holes found on the open end 62 of the backside track 46 and the rear portion 64 of the base bar 36.

Now referring to FIG. 6, in yet another embodiment, a jaw support arm 72 is situated to be slideable relative to the forward facing support jaw 18. The jaw support arm 72 is preferably slideable such that a rearward facing support jaw 26 is adjustable to correspond effectively with the forward facing support jaw 18 when engaging the wrench type devices 12. Effective correspondence is further defined as optimally situating the rearward facing support jaw 26 and the forward facing support jaw 18 so that the driving screw 34 mounted on the base bar 36 will bring the lower part 20 of the wrench type devices 12 closer together. The jaw support arm 72 is also preferably fixedly and immovably attached to the rearward facing support jaw 26 to provide a more stable resistance force to resist the driving of the forward facing support jaw 18.

In the preferred embodiment, the jaw support arm 72 is cylindrically shaped to allow a circular rotation of the rearward facing support jaw 26. The circular rotation provides a means of fitting the lower part 20 of the wrench type devices 12 at various angles when the wrench type devices 12 are secured to the pipe coupling 14. The base bar 36 is provided with a sleeve 73 to receive the jaw support arm 72. Preferably, the jaw support arm 72 is fixedly secured to the base bar 36 by a locking key 74. The locking key 74 is fed into a key hole 76 found on the sleeve 73 until it comes into contact with the jaw support arm 72. The key hole 76 is preferably provided with a tethering to allow the locking key 74 of a screw type design to securely tighten onto the jaw support arm 72.

While a particular embodiment of the loosening tool has been described herein, it will be appreciated by those skilled in the art that changes and modifications may be made thereto without departing from the invention in its broader aspects and as set forth in the following claims.

The invention claimed is:

1. A loosening tool for breaking loose tightened threads of a pipe coupling using a plurality of wrench type devices, the loosening comprising:

a forward facing support jaw;

a rearward facing support jaw positioned to correspond with said forward facing support jaw when supporting the wrench type devices;

a means of adjusting said forward facing support jaw from a ready position to a extended position such that said forward facing support jaw and said rearward facing support jaw are moved closer together; and a base bar used to support said rearward facing support jaw and said means of adjusting forwarding facing support jaw, wherein said base bar is further provided with a backside track.

2. The loosening tool of claim 1, wherein said forward facing support jaw is supportable to a lower part of a wrench type device.

3. The loosening tool of claim 2, wherein said forward facing support jaw is further provided with a base support member.

4. The loosening tool of claim 2, wherein said forward facing support jaw is further provided with a set of arms to prevent unintentional sliding of the lower part of the wrench type device.

5. The loosening tool of claim 1, wherein said rearward facing support jaw is attached to an adjustable slide situated on said backside track.

6. The loosening tool of claim 5, wherein said rearward facing support jaw is attached to said adjustable slide with a rearward ball joint fitting.

7. The loosening tool of claim 5, wherein said rearward facing support jaw is held onto said backside track with a slide stopper.

8. The loosening tool of claim 1, wherein said rearward facing support jaw is supportable to a lower part of a second wrench type device.

9. The loosening tool of claim 1, wherein said means of adjusting said forward facing support jaw from said ready position to said extended position is provided by a driving screw mounted on said base bar such that said forward facing support jaw is drivable in a direction towards said rearward facing support jaw.

10. The loosening tool of claim 9, wherein said driving screw is rotatably attached to a rear side of said forward facing support jaw such that said forward facing support jaw is moveable from said ready position to said extended position while continually supporting a lower part of a wrench type device.

11. The loosening tool of claim 10, wherein said driving screw is rotatably attached by a forward ball joint fitting.

12. A loosening tool for breaking loose tightened threads of a pipe coupling using a plurality of wrench type devices, the loosening comprising:

a forward facing support jaw;

a rearward facing support jaw positioned to correspond with said forward facing support jaw when supporting the wrench type devices;

an adjusting mechanism used to move said forward facing support jaw from a ready position to a extended position such that said forward facing support jaw and said rearward facing support jaw are moved closer together;

a jaw support arm situated to be slideable relative to said forward facing support jaw and fixedly attached to said rearward facing support jaw; and a base bar used to support said jaw support arm and said adjustable mechanism, wherein said jaw support arm is fixedly secured to said base bar by a locking key.

13. The loosening tool of claim 12, wherein said jaw support arm is cylindrically shaped to allow a circular rotation of said rearward facing support jaw.

14. The loosening tool of claim 12, wherein said base bar is provided with a sleeve to receive said jaw support arm.

15. A loosening tool for breaking loose tightened threads of a pipe coupling using a plurality of wrench type devices, the loosening comprising:

a forward facing support jaw;

a rearward facing support jaw positioned to correspond with said forward facing support jaw when supporting the wrench type devices;

an adjusting mechanism used to move said forward facing support jaw from a ready position to a extended position such that said forward facing support jaw and said rearward facing support jaw are moved closer together;

a jaw support arm situated to be slideable relative to said forward facing support jaw and fixedly attached to said rearward facing support jaw, wherein said jaw support arm is cylindrically shaped to allow a circular rotation of said rearward facing support jaw; and a base bar used to support said jaw support arm and said adjustable mechanism.

* * * * *